US008725050B2

(12) United States Patent
Ohtsu et al.

(10) Patent No.: US 8,725,050 B2
(45) Date of Patent: May 13, 2014

(54) SLIDING MEMBER FOR FIXING DEVICE, FIXING DEVICE, AND IMAGE FORMING APPARATUS

(75) Inventors: Shigemi Ohtsu, Kanagawa (JP); Koichi Matsumoto, Kanagawa (JP); Satoshi Mizoguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 299 days.

(21) Appl. No.: 13/362,787

(22) Filed: Jan. 31, 2012

(65) Prior Publication Data

US 2013/0034374 A1 Feb. 7, 2013

(30) Foreign Application Priority Data

Aug. 1, 2011 (JP) ..... 2011-168684

(51) Int. Cl.
*G03G 15/20* (2006.01)

(52) U.S. Cl.
CPC ..... *G03G 15/2064* (2013.01)
USPC ..... 399/329; 399/333

(58) Field of Classification Search
CPC ..... G03G 15/2064
USPC ..... 399/329, 333
See application file for complete search history.

(56) References Cited

U.S. PATENT DOCUMENTS

| | | | | |
|---|---|---|---|---|
| 5,985,949 | A | 11/1999 | Seguchi et al. | |
| 6,456,819 | B1 | 9/2002 | Abe et al. | |
| 6,465,575 | B1 | 10/2002 | Kusano et al. | |
| 6,895,208 | B2 * | 5/2005 | Nakatogawa et al. | 399/329 |
| 2006/0216077 | A1 * | 9/2006 | Komuro | 399/328 |
| 2009/0014942 | A1 | 1/2009 | Okuno | |
| 2010/0296849 | A1 * | 11/2010 | Yamamoto et al. | 399/329 |

FOREIGN PATENT DOCUMENTS

| | | |
|---|---|---|
| JP | A-09-278907 | 10/1997 |
| JP | A-2000-129019 | 5/2000 |
| JP | A-2001-042670 | 2/2001 |
| JP | A-2002-025759 | 1/2002 |
| JP | A-2002-299007 | 10/2002 |
| JP | A-2003-107936 | 4/2003 |
| JP | A-2003-191389 | 7/2003 |
| JP | A-2005-003968 | 1/2005 |
| JP | A-2005-003969 | 1/2005 |
| JP | A-2005-331576 | 12/2005 |
| JP | A-2009-015227 | 1/2009 |

* cited by examiner

*Primary Examiner* — Walter L Lindsay, Jr.
*Assistant Examiner* — Rodney Bonnette
(74) *Attorney, Agent, or Firm* — Oliff PLC

(57) ABSTRACT

A sliding member for a fixing device includes a base body and a sliding sheet that is disposed on the surface of the base body and is made of cross-linked polytetrafluoroethylene provided with through holes passing therethrough in a thickness direction.

11 Claims, 6 Drawing Sheets

SLIDING MEMBER FOR FIXING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2011-168684 filed Aug. 1, 2011.

BACKGROUND (i) Technical Field

The present invention relates to a sliding member for a fixing device, a fixing device, and an image forming apparatus.

(ii) Related Art

In image forming apparatuses, such as a copy machine and a printer using an electrophotographic method, unfixed toner images formed on a recording sheet are fixed to the recording sheet by a fixing device so that an image is formed.

Fixing devices, which are called belt-nip type fixing devices and have a structure that includes a heating roll and a pressure belt disposed so as to come into contact with the heating roll or a structure that includes a heating belt and a pressure roll disposed so as to come into contact with the heating belt, are known as the fixing device.

In these fixing devices, a belt is disposed so as to be pressed against a roll from the inner surface by a pressing member and a sliding member is interposed between the belt and the pressing member in order to reduce sliding resistance that is generated by the rotation of the belt.

SUMMARY

According to an aspect of the invention, there is provided a sliding member for a fixing device, the sliding member including: a base body; and a sliding sheet that is disposed on the surface of the base body and is made of cross-linked polytetrafluoroethylene provided with through holes passing therethrough in a thickness direction.

BRIEF DESCRIPTION OF THE DRAWINGS

Exemplary embodiments of the present invention will be described in detail based on the following figures, wherein.

DETAILED DESCRIPTION

Exemplary embodiments will be described in detail below with reference to the drawings.

(Sliding Member for Fixing Device)

Figure 1A:
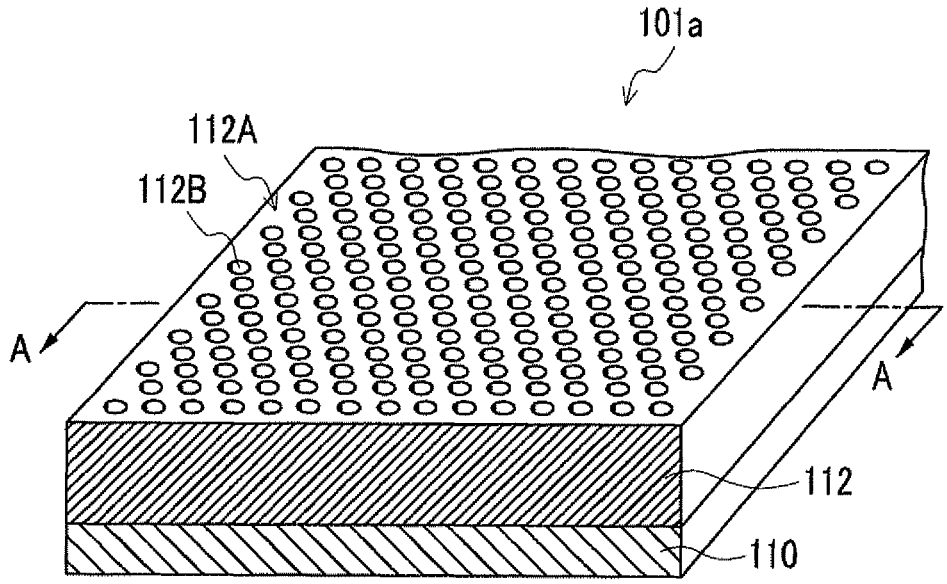
FIGS. 1A and 1B are schematic perspective views showing an example of a sliding member for a fixing device according to an exemplary embodiment.
Figure 1B:
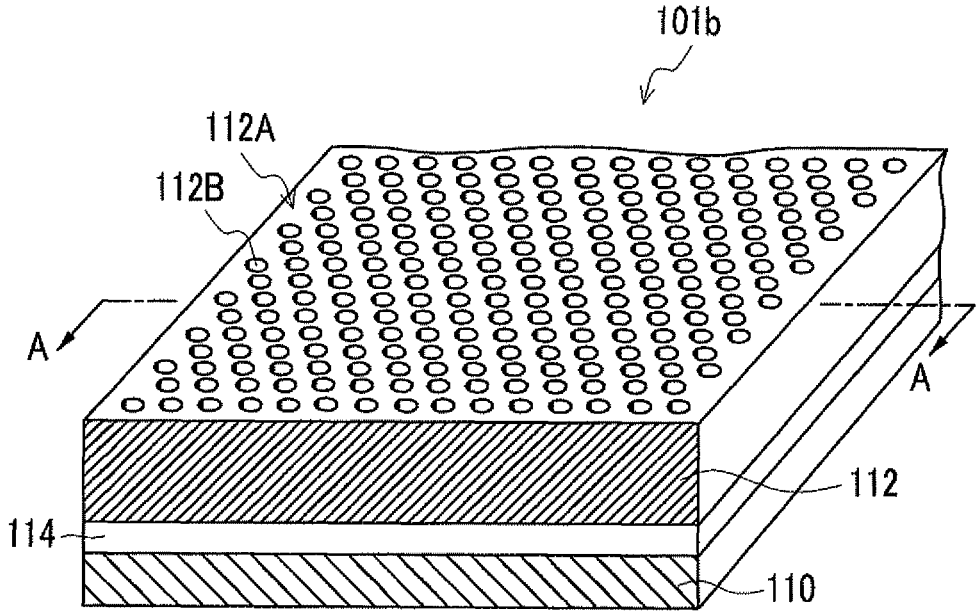
Figure 2A:
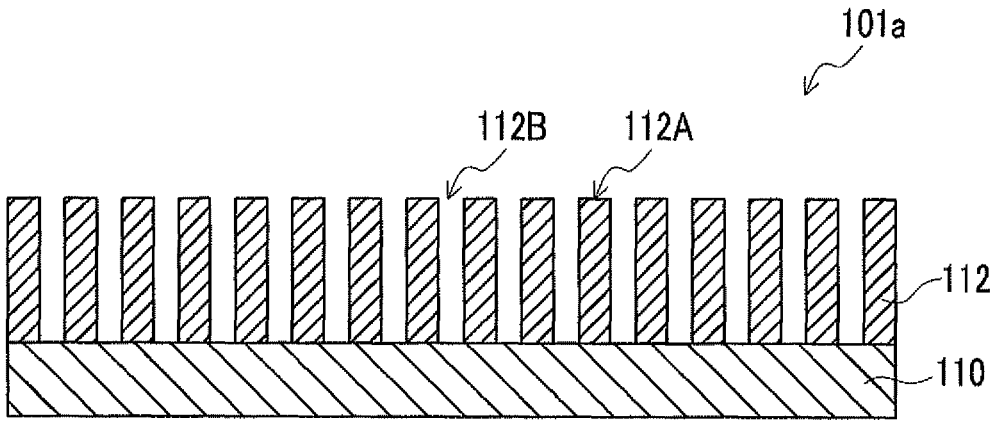
FIGS. 2A and 2B are cross-sectional views take along lines A-A of FIGS. 1A and 1B.
Figure 2B:
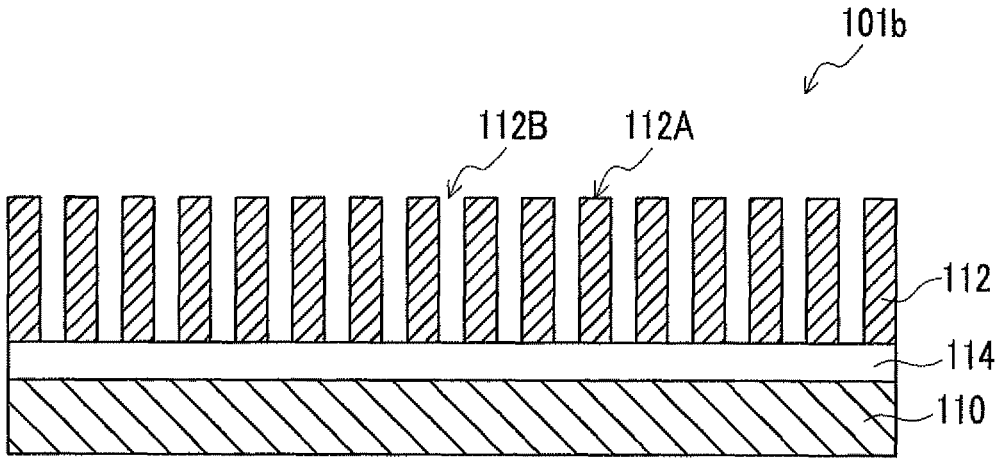

FIGS. 1A and 1B are schematic perspective view showing an example of a sliding member for a fixing device according to an exemplary embodiment. FIGS. 2A and 2B are cross-sectional views take along lines A-A, of FIGS. 1A and 1B.

Hereinafter, a "sliding member for a fixing device" may be simply referred to as a "sliding member".

—Structure of Sliding Member—

As shown in FIGS. 1A and 2A, a sliding member 101*a* according to this exemplary embodiment includes, for example, a sheet-like base body 110 and a sliding sheet 112 that is provided on the base body 110 and made of cross-linked polytetrafluoroethylene (an adhesive layer, which makes the base body 110 and the sliding sheet 112 adhere to each other, is not shown).

Further, as shown in FIGS. 1B and 2B, a sliding member 101*b* according to this exemplary embodiment has, for example, a structure where a sliding sheet 112 made of cross-linked polytetrafluoroethylene is laminated on a sheet-like base body 110 with a fluorine resin fiber layer 114 interposed therebetween (an adhesive layer, which makes the base body 110 and the fluorine resin fiber layer 114 adhere to each other, is not shown and an adhesive layer, which makes the fluorine resin fiber layer 114 and the sliding sheet 112 adhere to each other, is not shown).

Hereinafter, "cross-linked polytetrafluoroethylene" is appropriately referred to as "cross-linked PTFE".

Further, the sliding sheets 112 of the sliding members 101*a* and 101*b* are layers that form planar sliding surfaces 112A of the sliding members 101*a* and 101*b*. Through holes 112B, which pass through the sliding sheets from the planar sliding surfaces 112A in a thickness direction, are scattered at the sliding sheets.

Here, in the past, it has been known that embossing using, for example, meshes is applied to a sliding surface of a sliding member and lattice-like concave and convex portions are formed on the sliding surface so that a lubricant is easily held between the sliding member and a member subjected to sliding or sliding resistance is reduced.

When deep concave portions are to be formed by the embossing, the sliding surface may be distorted or the restoration of the shape of the sliding surface may occur. As a result, the deep concave portions, which exhibit desired oil holding performance, have tended to be not easily formed on the sliding surface.

In contrast, the sliding sheet 112, where the through holes 112B passing through the sliding sheet from the sliding surface 112A in the thickness direction are scattered, is disposed on the surface of the base body 110 in the sliding member 101*a* according to this exemplary embodiment.

Further, the sliding sheet 112, where the through holes 112B passing through the sliding sheet from the sliding surface 112A in the thickness direction are scattered, is disposed on the surface of the base body 110 with the fluorine resin fiber layer 114 interposed therebetween in the sliding member 101*b* according to this exemplary embodiment.

According to this structure, concave portions are formed in the sliding member 101*a* by the through holes 1128 of the sliding sheet 112 and the surface of the base body 110 as shown in FIG. 2A, and concave portions are formed in the sliding member 101*b* by the through holes 112B of the sliding sheet 112 and the surface of the base body 110, which is disposed with the fluorine resin fiber layer 114 interposed between the sliding sheet 112 and the base body 110, as shown in FIG. 2B.

Since the concave portions, which are formed as described above, have a depth equal to the thickness of the sliding sheet 112, the sliding members have excellent oil holding performance. In particular, since the fluorine resin fiber layer 114 is present between the sliding sheet 112 and the base body 110 in the sliding member 101*b*, the amount of oil held by the sliding member 101*b* is larger than the amount of oil held by the sliding member 101*a*.

Much oil is discharged to the outside from the concave portions in the sliding member that includes the concave portions so as to hold much oil as described above. Accordingly, even when abrasion powder is generated due to the abrasion between the sliding member and a member subjected to sliding, the clogging of the concave portions caused by the abrasion powder is suppressed. As a result, the life of the sliding member itself is lengthened.

Further, in each of the sliding members 101*a* and 101*b* according to this exemplary embodiment, the sliding sheet 112 is laminated on the base body 110 and the sliding sheet 112, which forms the sliding surface 112A, is supported by the base body 110.

Accordingly, the deformation of the sliding sheet 112, which is caused by sliding between the sliding member and a member subjected to sliding, is suppressed.

Components of the sliding members 101*a* and 101*b* according to this exemplary embodiment will be specifically described below.

First, the sliding sheet 112 common to the sliding members 101*a* and 101*b* will be described.

The sliding sheet 112 is made of cross-linked PTFE and may include additives such as fillers as occasion demands.

Further, the sliding surface 112A of the sliding sheet 112 is formed in a planar shape (is formed of a flat surface), and the through holes 112B, which pass through the sliding sheet from the sliding surface 112A in the thickness direction, are present at the sliding sheet so as to be scattered.

Next, the through holes 112B will be described.

The through holes 112B, which are scattered at the sliding sheet 112, have a circular shape when seen, for example, in a direction perpendicular to the sliding surface 112A.

Specifically, the shape of each of the through holes 112B on the sliding surface 112A is a circular shape, and the shape of each of the through holes 112B on the surface of the sliding sheet 112 opposite to the sliding surface 112A is also a circular shape. That is, the through holes 112B are formed in a cylindrical shape.

Meanwhile, the shape of each of the through holes 112B on the sliding surface 112A and the shape of each of the through holes 112E on the surface of the sliding sheet 112 opposite to the sliding surface 112A may be equal to each other. However, the size (diameter) of each of the through holes 112B on the sliding surface 112A and the size (diameter) of each of the through holes 112B on the surface of the sliding sheet 112 opposite to the sliding surface 112A may be equal to each other and be different from each other.

Meanwhile, the shape of each of the through holes 112B on the sliding surface 112A is not limited to the circular shape shown in FIG. 1, and may be an oval shape or a polygonal shape (a quadrangular shape or other polygonal shapes). However, in terms of the ease of machining, it is preferable that the shape of each of the through holes 112B on the sliding surface 112A be a circular shape.

Further, when seen, for example, in the direction perpendicular to the sliding surface 112A, the through holes 11213 are arrayed in a lattice shape at specific intervals in one direction and a direction crossing (for example, orthogonal to) this direction.

Meanwhile, the array form of the through holes 11213 is not limited to the lattice shape, and may be a zigzag lattice shape or an irregular shape.

The area of each of the through holes 112B on the sliding surface 112A may be in the range of $7\times10^{-3}$ $mm^2$ to 3.2 $mm^2$ (preferably, 0.03 $mm^2$ to 0.8 $mm^2$).

Specifically, when the shape of each of the through holes 112B on the sliding surface 112A is a circular shape, the diameter of each of the through holes 11213 may be in the range of 100 μm to 2 mm (preferably, 150 μm to 1 mm).

Further, an interval (array pitch) between the through holes 112B, that is, a distance between adjacent through holes 112B may be in the range of 0.2 mm to 2.0 mm (preferably, 0.3 mm to 1.5 mm).

In particular, in terms of suppressing the influence on an image while maintaining oil holding performance, it is preferable that the area of each of the through holes be in the above-mentioned range and the interval between the through holes 112B be in the above-mentioned range.

A ratio of the area of all the through holes 112B to the entire area of the sliding surface 112A may be in the range of 10% to 50% (preferably, 20% to 45%).

Next, cross-linked PTFE, which forms the sliding sheet 112, will be described.

Cross-linked PTFE, which forms the sliding sheet 112, is cross-linked PTFE that is obtained by crosslinking uncross-linked PTFE through the irradiation of, for example, uncross-linked PTFE with ionizing radiation.

Specifically, cross-linked PTFE is obtained by crosslinking uncross-linked PTFE through the irradiation of, for example, uncross-linked PTFE, which is heated to a temperature higher than a crystalline melting point, with ionizing radiation (for example, a y ray, an electron beam, an X ray, a neutron ray, high-energy ions, or the like) having an irradiation dose in the range of 1 KGy to 10 MGy in the absence of oxygen.

Meanwhile, PTFE may include other copolymer components (perfluoro(alkyl vinyl ether), hexafluoropropylene, perfluoro(alkyl vinyl ether), hexafluoropropylene, (perfluoroalkyl)ethylene, chlorotrifluoroethylene or the like) other than tetrafluoroethylene.

Fillers and other additives will be described.

Fillers are added to impart electrical conductivity and to improve durability and thermal conductivity.

For example, at least one selected from a group consisting of metal oxide particles, silicate minerals, carbon black, and nitrogenous compounds may be used as the filler.

Among these, Ketjen black, graphite, and acetylene black are preferable for imparting electrical conductivity; and graphite, copper, silver, aluminum nitride, boron nitride, alumina, and the like are preferable for imparting thermal conductivity. As the filler, one may be used alone and two or more may be used together.

The average particle diameter of the filler may be in the range of, for example, 0.01 μm to 20 μm.

Filler content may be in the range of 0.01 parts by mass to 30 parts by mass based on 100 parts by mass of, for example, a cross-linked PTFE component.

Meanwhile, in addition to the filler, other additives may be mixed to the sliding sheet 112 in accordance with the purpose.

The thickness of the sliding sheet 112 is set in the range of, for example, 30 μm to 500 vim (preferably, 50 μm to 300 μm).

That is, since this thickness and the depth of the through hole 112B are equal to each other, the above-mentioned range becomes the range of the depth of the through hole 112B.

Meanwhile, the thickness of the sliding sheet may be set according to the rigidity of the sheet itself or the kind and shape of the base body on which the sliding sheet is disposed.

Next, the sheet-like base body 110 common to the sliding members 101*a* and 101*b* will be described.

The sheet-like base body 110 is made of, for example, a resin material and an additive such as a filler that is added as occasion demands.

Examples of the resin material include a polyimide resin, a polyamide resin, a polyamide-imide resin, a polyether ether ester resin, a polyarylate resin, a polyester resin, and a polyester resin that is formed by adding a reinforcing material. However, a polyimide resin having high heat resistance and high mechanical strength is preferable among these.

The thickness of the sheet-like base body 110 is set in the range of, for example, 50 μm to 150 μm (preferably, 60 μm to 130 μm).

Subsequently, the fluorine resin fiber layer 114 of the sliding member 101*b* according to this exemplary embodiment will be described.

The fluorine resin fiber layer 114 is a layer that is present between the base body 110 and the sliding sheet 112 including the through holes 112B and is made of fiber. Since the fluorine resin fiber layer 114 has a function of holding oil in the layer, oil present in the respective through holes 112B moves through the fluorine resin fiber layer 114. As a result, the sliding member 101*b* has excellent oil holding performance and excellent in-plane uniformity thereof.

For example, PTFE fiber and heat-resistant aramid fiber are used as the fluorine resin fiber layer 114. PTFE fiber, which has high heat resistance and high adhesiveness to the sliding sheet 112 made of cross-linked PTFE, is preferable between them.

Specifically, GORE FIBER CLOTH FS120-E (trade name) (manufactured by Japan Gore-Tex, Inc., thickness: 120 μm) is used as PTFE fiber.

Here, adhesive layers, which are not shown in FIGS. 1 and 2, will be described.

First, an adhesive layer, which makes the base body 110 and the sliding sheet 112 adhere to each other, is present in the sliding member 101*a*.

This adhesive layer may be formed of an adhesive sheet so as not to fill the through holes 112B of the sliding sheet 112. Further, an adhesive sheet, which includes holes having the same shape as the through hole 1128 of the sliding sheet 112, may be used as the adhesive layer.

Furthermore, two adhesive layer, that is, an adhesive layer that makes the base body 110 and the fluorine resin fiber layer 114 adhere to each other and an adhesive layer that makes the fluorine resin fiber layer 114 and the sliding sheet 112 adhere to each other are present in the sliding member 101*b*.

An adhesive sheet may be used as the adhesive layer, which is interposed between the base body 110 and the fluorine resin fiber layer 114, without particular limitation, but the adhesive layer interposed between the base body 110 and the fluorine resin fiber layer 114 may be made of a known adhesive, such as a heat-resistant silicon resin or an epoxy-based resin.

The adhesive layer, which makes the fluorine resin fiber layer 114 and the sliding sheet 112 adhere to each other, may be formed of an adhesive sheet that include holes having the same shape as the through hole 112B of the sliding sheet 112 so as not to fill the through holes 1128 of the sliding sheet 112.

As each of the above-mentioned adhesive sheets, there may be used a fluorine-based adhesive sheet, which causes thermal fusion bonding by being heated to a temperature equal to or higher than a melting point, thereby making the base body 110 and the sliding sheet 112 adhere to each other, making the base body 110 and the fluorine resin fiber layer 114 adhere to each other, and making the fluorine resin fiber layer 114 and the sliding sheet 112 adhere to each other. In particular, since a fluorine-based adhesive sheet does not interact with oil and can suppress deterioration caused by oil, a fluorine-based adhesive sheet is preferable.

Specifically, SILKY BOND (trade name) (manufactured by Junkosha Co., Ltd.) is used as the fluorine-based adhesive sheet.

Further, the thickness of the adhesive sheet is set in the range of 10 μm to 30 μm.

—Manufacturing Method—

Next, a method of manufacturing the sliding members 101*a* and 101*b* according to this exemplary embodiment will be described.

First, a sheet forming the base body 110, a sheet that forms the sliding sheet 112, and a sheet that forms the fluorine resin fiber layer 114 in the case of the sliding member 101*b* are prepared.

Next, the through holes 112B are formed at the sliding sheet 112.

A laser machining method, machining using drills, punching using a die, and the like are used in the formation of the through holes 112B. Punching may be used when the diameter of the hole is relatively large (for example, when the diameter of the hole exceeds 0.3 mm), and laser may be used when the diameter of the hole is relatively small (for example, when the diameter of the hole is smaller than 0.5 mm).

Here, $CO_2$ laser, excimer laser, or the like is used in the laser machining method.

Meanwhile, when the sliding member 101*b* is manufactured, through holes are formed even at the fluorine-based adhesive sheet.

The same method as the method, which is used in the formation of the through holes 112B of the sliding sheet 112, is used in the formation of these holes. The shapes and positions of the through holes of the fluorine-based adhesive sheet are set so that the through holes 112B of the sliding sheet 112 communicate with the through holes of the fluorine-based adhesive sheet when the sliding sheet 112 is laminated on the fluorine-based adhesive sheet.

The through holes 112B of the sliding sheet 112 and the through holes of the fluorine-based adhesive sheet will be described below with reference to FIG. 3. Here, FIG. 3 is a top view illustrating a relationship between the through holes 112B of the sliding sheet 112 and the through holes of the fluorine-based adhesive sheet.

Figure 3C:
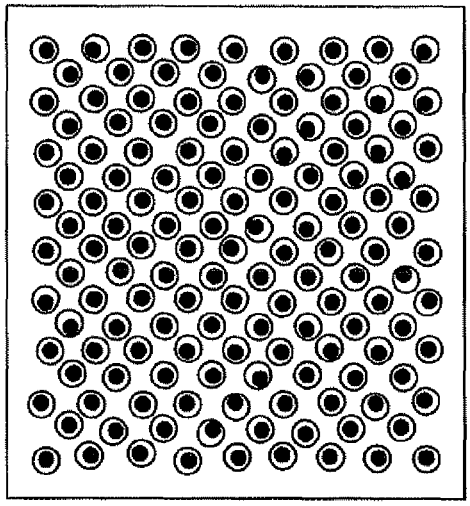
FIGS. 3A to 3C are top views illustrating a relationship between through holes of a sliding sheet and through holes of a fluorine-based adhesive sheet.
Figure 3A:
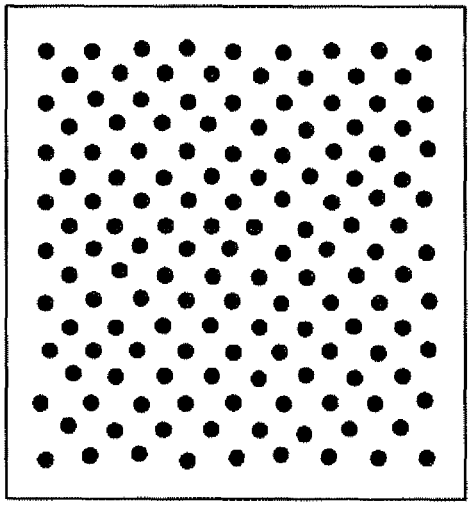
Figure 3B:
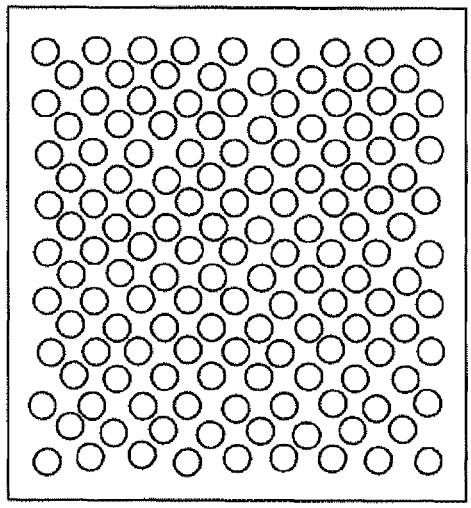

For example, the respective circular through holes of the sliding sheet 112 including the through holes 112B shown in FIG. 3A and the respective circular through holes of the fluorine-based adhesive sheet including the through holes shown in FIG. 3B may be formed so as to communicate with each other as shown in FIG. 3C when the sliding sheet 112 is laminated on the fluorine-based adhesive sheet. As shown in FIG. 3C, the diameter of each of the through holes formed at the fluorine-based adhesive sheet is larger than the diameter of each of the through holes 112B of the sliding sheet 112. Since the through holes are formed in this way, it is possible to make the sliding sheet 112 adhere to a sheet forming the fluorine resin fiber layer 114 without closing the through holes 112B of the sliding sheet 112. Meanwhile, the diameter of each of the through holes formed at the fluorine-based adhesive sheet may be equal to the diameter of each of the through holes 112B of the sliding sheet 112.

Further, the fluorine-based adhesive sheet, which is used to manufacture the sliding member 101*a*, may include through holes and may not include through holes.

Subsequently, in the case of the sliding member 101*a*, a sheet forming the base body 110 and the sliding sheet 112 including the through holes 112B are bonded to each other by the fluorine-based adhesive sheet.

This bonding is performed by making the fluorine-based adhesive sheet be interposed between the sheet forming the base body 110 and the sliding sheet 112 including the through holes 112B, that is, forming a laminated body of the sheet forming the base body 110, the fluorine-based adhesive sheet, and the sliding sheet 112 including the through holes 112B; applying pressure to the laminated body from the upper and lower sides of the laminated body; and further heating the laminated body.

Moreover, in the case of the sliding member 101*b*, a sheet forming the base body 110 and a sheet forming the fluorine resin fiber layer 114 are bonded to each other by a fluorine-based adhesive sheet (without through holes), and the sheet forming the fluorine resin fiber layer 114 and the sliding sheet 112 including the through holes 112B are bonded to each other by a fluorine-based adhesive sheet including through holes.

This bonding is performed by forming a laminated body of the sheet forming the base body 110, the fluorine-based adhesive sheet (without through holes), the sheet forming the fluorine resin fiber layer 114, the fluorine-based adhesive sheet including through holes, and the sliding sheet 112 including the through holes 112B; applying pressure to the laminated body from the upper and lower sides of the laminated body; and further heating the laminated body.

The pressure, which is applied to the laminated body during the above-mentioned bonding, may be set in the range of 1.0 MPa to 2.0 MPa, and a heating temperature may be set in the range of 320° to 350°.

The sliding members 101*a* and 101*b* according to this exemplary embodiment are manufactured through the above-mentioned processes.

Each of the above-mentioned sliding members 101*a* and 101*b* according to this exemplary embodiment has been a sheet-like member that includes at least the sheet-like base body 110 and the sliding sheet 112, but may be formed in the following form.

That is, a base body may be formed of a pressing member (pressing pad) made of metal, and examples of the sliding member according to this exemplary embodiment also include a sliding pad where the sliding sheet 112 including the through holes 112B is disposed on the surface of the base body. Examples of this sliding pad include a release pad of a fixing device, which is mounted on Color1000/800 PRESS manufactured by Fuji Xerox Co., Ltd. as disclosed in collection of preview documents of the 107th annual conference of Imaging Society of Japan.

[Fixing Device]

An example of the fixing device according to this exemplary embodiment will be described.

The fixing device according to this exemplary embodiment has various structures. Hereinafter, a fixing device, which includes a heating roll including a heating source and a pressing belt against which a pressing pad is pressed, will be described as a first exemplary embodiment and a fixing device, which includes a heating belt against which a heating source is pressed and a pressure roll, will be described as a second exemplary embodiment.

The above-mentioned sliding member according to this exemplary embodiment is applied as sheet-like sliding members of these fixing devices.

Here, the sliding member according to this exemplary embodiment is disposed, and the surface roughness Ra of the inner surface (inner peripheral surface) of a heating belt or a pressure belt as an example of a second rotating body, which comes into contact with the sliding surface of the sliding member, may be in the range of 0.1 μm to 2.0 μm (preferably, 0.3 μm to 1.5 μm).

Accordingly, the sliding resistance between the sliding member and the heating belt or the pressure belt as an example of the second rotating body is reduced, and a lubricant (oil) is particularly easily held between the sliding member and the second rotating body when being provided between the sliding member and the second rotating body. Therefore, the abrasion resistance of the sliding member is improved.

Meanwhile, under measurement conditions where an evaluation length Ln is 4 mm, a reference length L is 0.8 mm, and a cutoff value is 0.8 mm, the measurement of the surface roughness Ra is performed in conformity with JIS B0601-1994 by a surface roughness meter SUFCOM 1400A (manufactured by Tokyo Seimitsu Co., Ltd.).

—First Exemplary Embodiment of Fixing Device—

Figure 4:
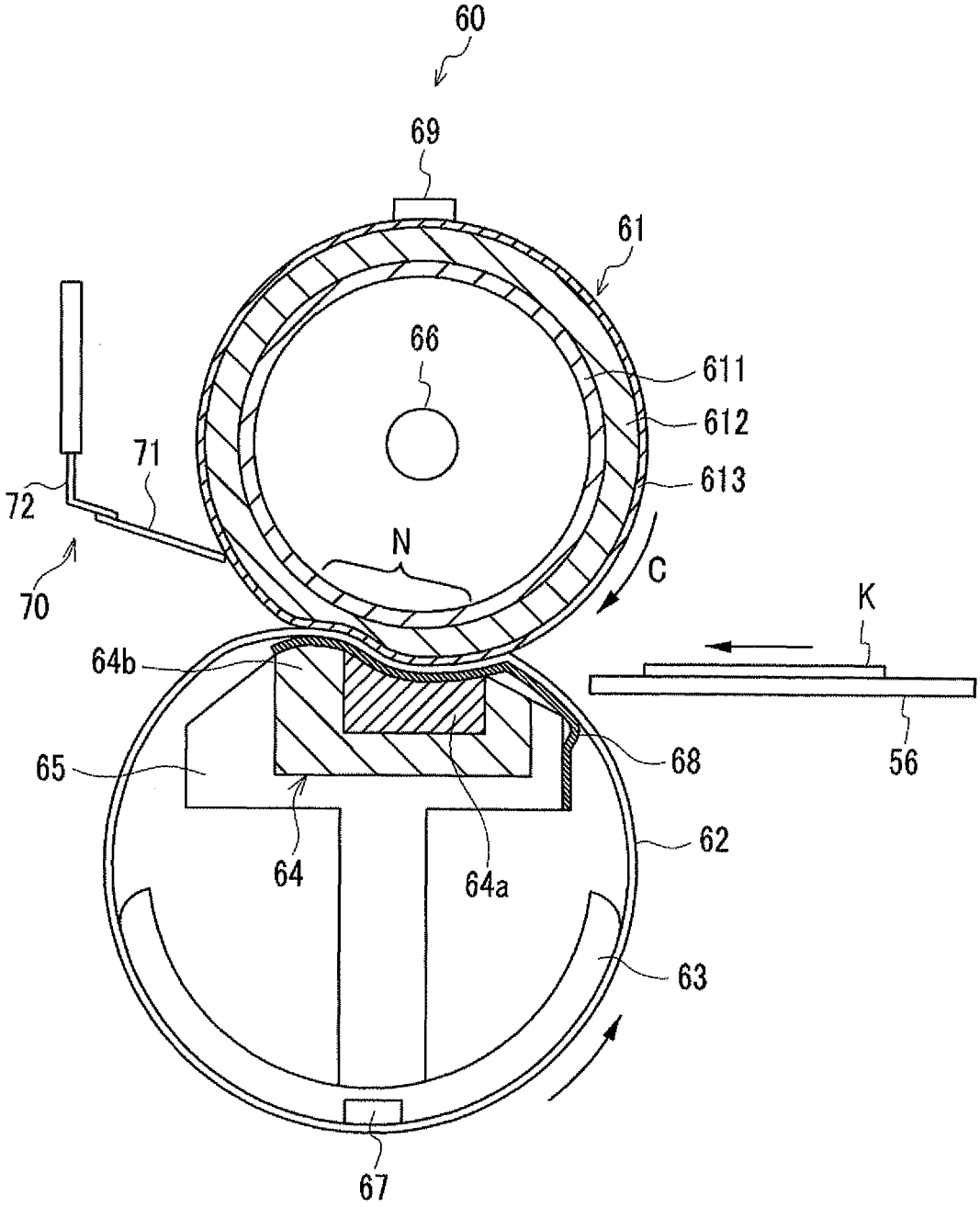
FIG. 4 is a schematic view showing the structure of a fixing device according to a first exemplary embodiment.

First, a fixing device 60 according to a first exemplary embodiment will be described. FIG. 4 is a schematic view showing the structure of the fixing device 60 according to the first exemplary embodiment.

As shown in FIG. 4, the fixing device 60 according to the first exemplary embodiment includes, for example, a heating roll 61 as an example of a first rotating body that is rotationally driven, a pressure belt 62 as an example of a second rotating body, and a pressing pad 64 as an example of a pressing member that presses the heating roll 61 with the pressure belt 62 interposed therebetween.

Meanwhile, the pressing pad 64 only has to make, for example, the pressure belt 62 and the heating roll 61 be pressed against each other. Accordingly, the pressure belt 62 may be pressed against the heating roll 61, or the heating roll 61 may be pressed against the pressure belt 62.

The heating roll 61 is a roll that is formed by laminating, for example, a heat-resistant elastic body layer 612 and a release layer 613 around a core (cylindrical core bar) 611 made of metal. A halogen lamp 66 as an example of a heating unit is provided in the heating roll 61. The heating unit is not limited to a halogen lamp, and other heat-generating members may be used as the heating unit.

Meanwhile, for example, a temperature sensing element 69 is disposed on the surface of the heating roll 61 so as to come into contact with the surface of the heating roll 61. The lighting of the halogen lamp 66 is controlled on the basis of a temperature value measured by the temperature sensing element 69, so that the surface temperature of the heating roll 61 is maintained at a predetermined set temperature (for example, 150° C.).

The pressure belt 62 is rotatably supported by, for example, the pressing pad 64 and a belt travel guide 63 that are disposed on the inside of the pressure belt. Further, the pressure belt is disposed so as to be pressed against the heating roll 61 at a nip area N (nip portion) by the pressing pad 64.

The pressing pad 64 is disposed, for example, on the inside of the pressure belt 62 so as to be pressed against the heating roll 61 with the pressure belt 62 interposed therebetween, and forms the nip area N between itself and the heating roll 61.

The pressing pad 64 includes, for example, a front nip member 64*a* that secures a wide nip area N and is disposed on the inlet side of the nip area N and a release-nip member 64*b* that applies a strain to the heating roll 61 and is disposed on the outlet side of the nip area N.

In order to reduce the sliding resistance between the inner peripheral surface of the pressure belt 62 and the pressing pad 64, a sheet-like sliding member 68 is provided, for example, on the surfaces of the front nip member 64*a* and the release-nip member 64*b*, which come into contact with the pressure belt 62. Further, the pressing pad 64 and the sliding member 68 are held by a holding member 65 made of metal.

Meanwhile, the sliding member 68 is provided so that, for example, the sliding surface of the sliding member comes into contact with the inner surface of the pressure belt 62. Accordingly, the sliding member 68 is involved in the holding and supply of oil that is present between the pressure belt and the sliding member 68. Since the sliding member according to this exemplary embodiment has excellent performance in the holding and supply of oil as described above, the holding and supply of oil is maintained in the fixing device for a long period of time. Accordingly, life of the fixing device is lengthened.

For example, the belt travel guide 63 is mounted on the holding member 65, so that the pressure belt 62 is rotated.

The heating roll 61 is rotated in the direction of an arrow C by, for example, a driving motor (not shown), and the pressure belt 62 is rotated in the direction opposite to the rotational direction of the heating roll 61 by the rotation of the heating roll. That is, for example, the heating roll 61 is rotated in the clockwise direction in FIG. 4 and the pressure belt 62 is rotated in the counterclockwise direction.

Further, a sheet K (recording medium) having an unfixed toner image is guided by, for example, a fixing inlet guide 56 and transported to the nip area N. Furthermore, when the sheet K passes through the nip area N, the toner image formed on the sheet K is fixed by pressure and heat that are applied to the nip area N.

In the fixing device 60 according to the first exemplary embodiment, for example, a wide nip area N, which is larger than the nip area of a structure without the front nip member 64*a*, is secured by the front nip member 64*a* that has a concave shape corresponding to the outer peripheral surface of the heating roll 61.

Furthermore, in the fixing device 60 according to the first exemplary embodiment, for example, the release-nip member 64*b* is disposed so as to protrude from the outer peripheral surface of the heating roll 61, so that the strain of the heating roll 61 in the outlet area of the nip area N is locally increased.

If the release-nip member 64*b* is disposed as described above, the sheet K to which the toner image has been fixed passes through the locally increased strain, for example, when passing through a release-nip area. Accordingly, the sheet K is apt to be released from the heating roll 61.

A release member 70 is provided as an auxiliary release member, for example, on the downstream side of the nip area N of the heating roll 61. The release member 70 includes a peeling claw 71 that is held by a holding member 72, for example, so as to be close to the heating roll 61 while facing the heating roll 61 in the direction opposite to the rotational direction of the heating roll 61 (counter direction).

—Second Exemplary Embodiment of Fixing Device—

Figure 5:
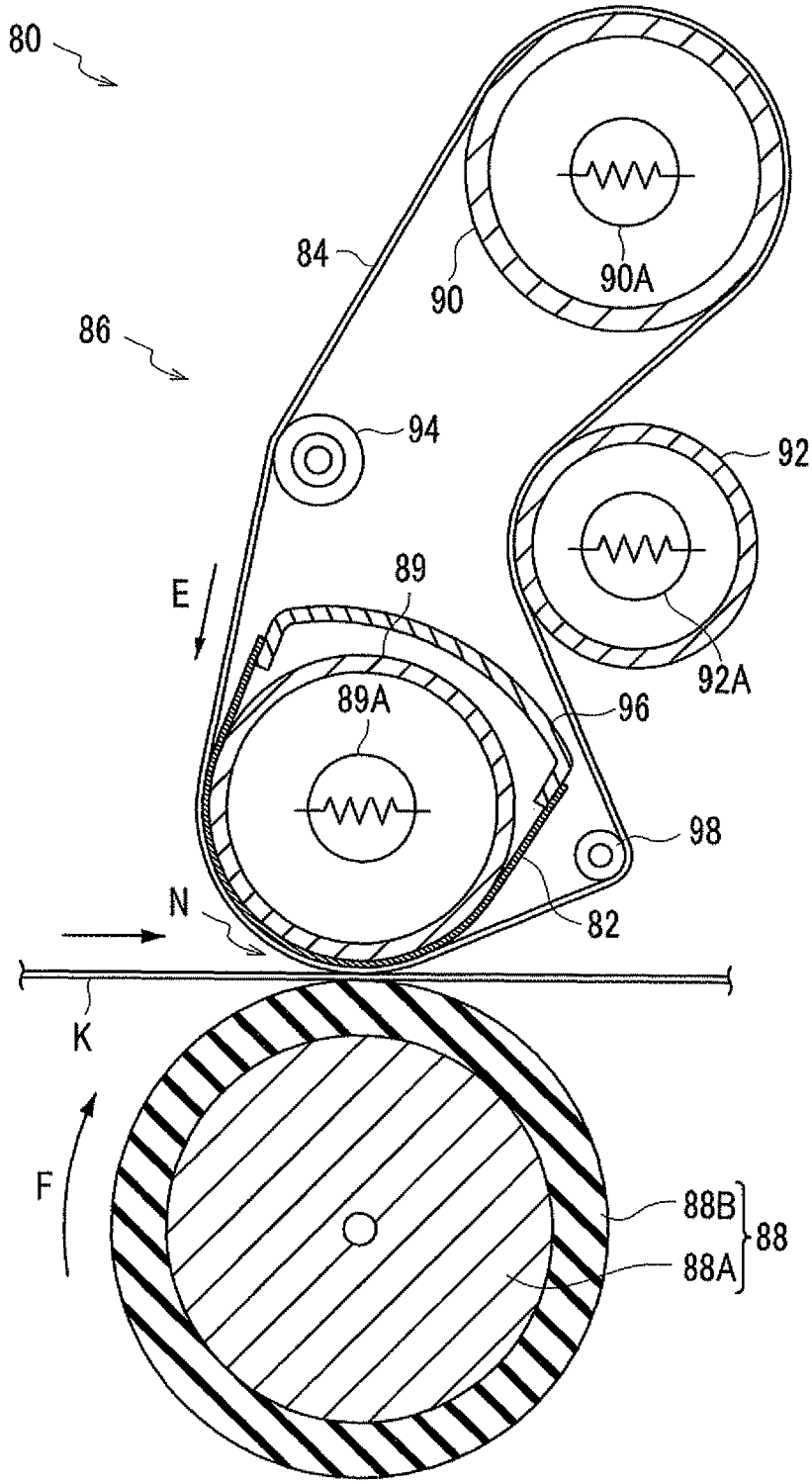
FIG. 5 is a schematic view showing the structure of a fixing device according to a second exemplary embodiment.

Next, a fixing device 80 according to a second exemplary embodiment will be described. FIG. 5 is a schematic view showing the structure of the fixing device 80 according to the second exemplary embodiment.

As shown in FIG. 5, the fixing device 80 according to the second exemplary embodiment includes, for example, a fixing belt module 86 that includes a heating belt 84 as an example of a second rotating body, and a pressure roll 88 as an example of a first rotating body that is disposed so as to be pressed against the heating belt 84 (fixing belt module 86). Further, for example, a nip area N (nip portion), where the heating belt 84 (fixing belt module 86) and the pressure roll 88 come into contact with each other, is formed. A sheet K as an example of a recording medium is pressed and heated at the nip area N, so that a toner image is fixed.

The fixing belt module 86 includes, for example, an endless heating belt 84, a heating-pressing roll 89 around which the heating belt 84 is wound on the side facing the pressure roll 88 and which is rotationally driven by the torque of a motor (not shown) and pushes the heating belt 84 toward the pressure roll 88 from the inner surface of the heating belt, and a support roll 90 that supports the heating belt 84 from the inside at a position different from the position of the heating-pressing roll 89.

The fixing belt module 86 is provided with, for example, a support roll 92 that is disposed on the outside of the heating belt 84 and specifies the circulating path of the heating belt; an attitude correcting roll 94 that corrects the attitude of a portion of the heating belt 84 between the heating-pressing roll 89 and the support roll 90; and a support roll 98 that applies tension to the heating belt 84 from the inner surface of the heating belt on the downstream side of the nip area N, which is an area where the heating belt 84 (fixing belt module 86) and the pressure roll 88 come into contact with each other.

Further, the fixing belt module 86 is provided so that the sheet-like sliding member 82 is interposed, for example, between the heating belt 84 and the heating-pressing roll 89.

The sliding member 82 is provided so that, for example, the sliding surface of the sliding member comes into contact with the inner surface of the heating belt 84. Accordingly, the sliding member 82 is involved in the holding and supply of oil that is present between the heating belt 84 and the sliding member 82. Since the sliding member according to this exemplary embodiment has excellent performance in the holding and supply of oil as described above, the holding and supply of oil is maintained in the fixing device for a long period of time. Accordingly, life of the fixing device is lengthened.

Here, the sliding member 82 is provided so that, for example, both ends of the sliding member are supported by a support member 96.

The heating-pressing roll 89 is a hard roll where a fluorine resin coating having a basis weight of 200 μm is formed on the surface of the core bar as a protective layer preventing the abrasion of metal of the surface of the cylindrical core bar made of aluminum.

For example, a halogen heater 89A as an example of a heating source is provided in the heating-pressing roll 89.

The support roll 90 is a cylindrical roll that is made of aluminum, and a halogen heater 90A as an example of a heating source is provided in the support roll 90. Accordingly, the support roll 90 is adapted to heat the heating belt 84 from the inner surface of the heating belt.

For example, spring members (not shown), which press the heating belt 84 to the outside, are provided at both end portions of the support roll 90.

The support roll 92 is a cylindrical roll made of, for example, aluminum. A release layer, which is made of a fluorine resin and has a thickness of 20 μm, is formed on the surface of the support roll 92.

The release layer of the support roll 92 is formed, for example, to prevent toner or paper powder from being deposited on the support roll 92 from the outer peripheral surface of the heating belt 84.

For example, a halogen heater 92A as an example of a heating source is provided in the support roll 92. Accordingly, the support roll 92 is adapted to heat the heating belt 84 from the outer peripheral surface of the heating belt.

That is, the heating belt 84 is adapted to be heated by, for example, the heating-pressing roll 89, the support roll 90, and the support roll 92.

The attitude correcting roll 94 is a cylindrical roll that is made of, for example, aluminum. An end position measuring mechanism (not shown), which measures the position of the end of the heating belt 84, is disposed near the attitude correcting roll 94.

The attitude correcting roll 94 is provided with, for example, an axial displacement mechanism (not shown) that displaces the contact position of the heating belt 84 in an axial direction according to the measurement result of the end position measuring mechanism. Accordingly, the attitude correcting roll 94 is adapted to control the meandering of the heating belt 84.

Meanwhile, the pressure roll 88 has a structure where a cylindrical roll 88A made of, for example, aluminum is used as a base body and an elastic layer 88B made of silicon rubber and a release layer including a fluorine resin having a thickness of 100 μm are laminated on the base body in this order from the base body. Further, the pressure roll 88 is rotatably supported, and is disposed so as to be pressed against a portion of the heating belt 84, which is wound around the heating-pressing roll 89, by an urging member such as a spring (not shown). Accordingly, the pressure roll 88 is adapted to be rotated in the direction of an arrow F by the heating belt (heating-pressing roll 89) as the heating belt 84 (heating-pressing roll 89) of the fixing belt module 86 is rotated in the direction of an arrow E.

Further, a sheet K having an unfixed toner image is guided to the nip area N of the fixing device 80, and the toner image is fixed by pressure and heat that are applied to the nip area N.

[Image Forming Apparatus]

Next, an image forming apparatus according to this exemplary embodiment will be described.

Figure 6:
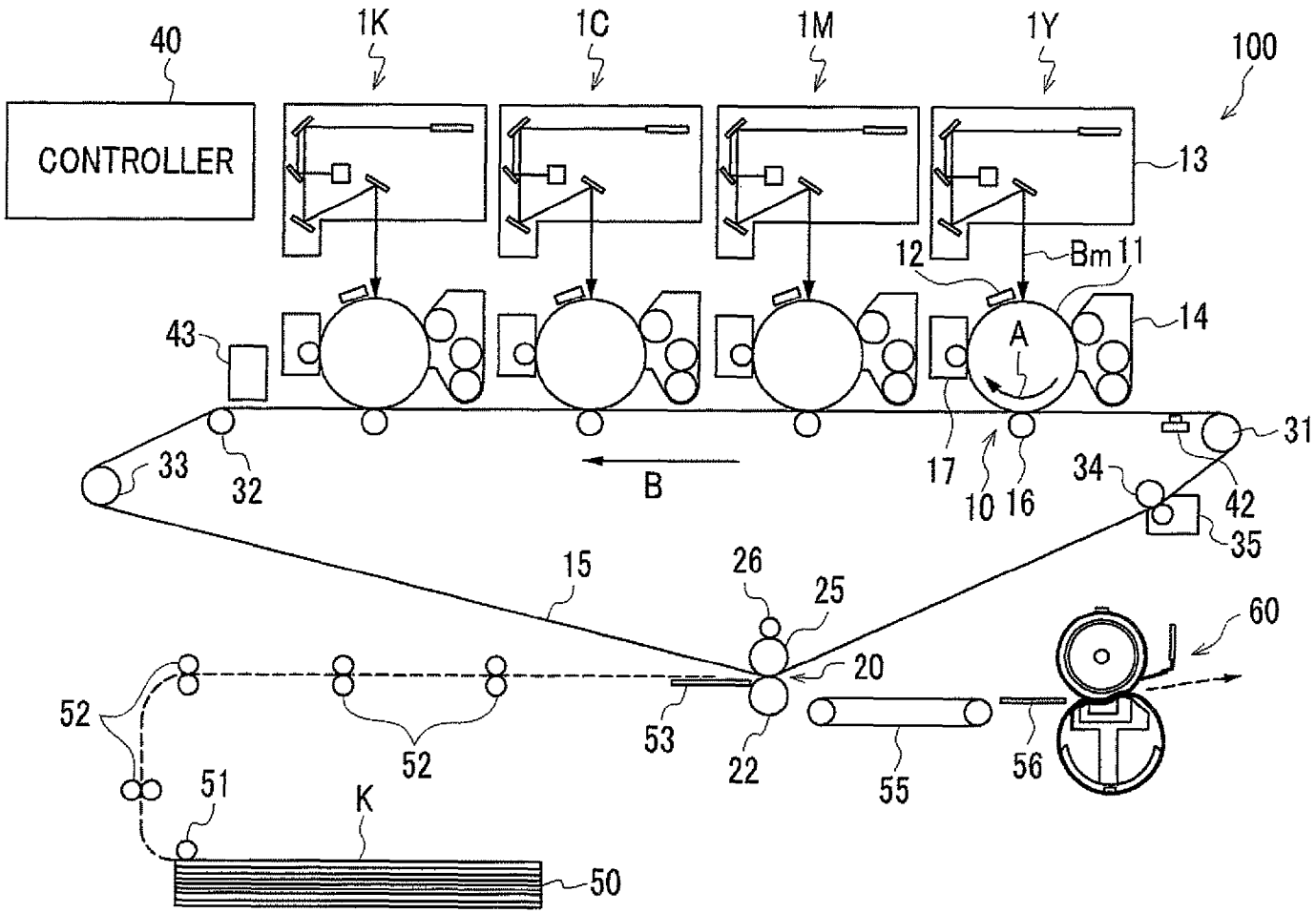
FIG. 6 is a schematic view showing the structure of an image forming apparatus according to this exemplary embodiment.

FIG. 6 is a schematic view showing the structure of an image forming apparatus according to this exemplary embodiment.

The fixing device according to the exemplary embodiment is applied to an image forming apparatus according to this exemplary embodiment.

As shown in FIG. 6, the image forming apparatus 100 according to this exemplary embodiment is an intermediate transfer type image forming apparatus that is generally called a tandem type image forming apparatus. The image forming apparatus 100 includes plural image forming units 1Y, 1M, 1C, and 1K that form toner images having respective color components by an electrophotographic method; primary transfer sections 10 that sequentially transfer (primarily transfers) the respective color toner images, which are formed by the respective image forming units 1Y, 1M, 1C, and 1K, to an intermediate transfer belt 15; a secondary transfer section 20 that collectively transfers (secondarily transfers) the superimposed toner images, which are transferred to the intermediate transfer belt 15, to a sheet K, which is a recording medium; and a fixing device 60 that fixes the secondarily transferred images to the sheet K. Further, the image forming apparatus 100 includes a controller 40 that controls the operations of each device (each section).

The fixing device 60 is the above-mentioned fixing device 60 according to the first exemplary embodiment, and the fixing device includes the above-mentioned sliding member 68 according to this exemplary embodiment. Meanwhile, the image forming apparatus 100 may include the above-mentioned fixing device 80 according to the second exemplary embodiment (the above-mentioned sliding member 82 according to this exemplary embodiment).

Each of the image forming units 1Y, 1M, 1C, and 1K of the image forming apparatus 100 includes a photoconductor 11, which is rotated in the direction of an arrow A, as an example of an image supporting body that supports a toner image formed on the surface thereof.

Around the photoconductor 11, a charger 12, which charges the photoconductor 11, is provided as an example of a charging unit that charges the surface of the image supporting body, and a laser exposure unit 13 (in FIG. 6, an exposure beam is denoted by reference character Bm), which writes an electrostatic latent image on the photoconductor 11, is provided as an example of a latent image forming unit that forms a latent image on the surface of the image supporting body charged by the charging unit.

Further, around the photoconductor 11, a developing section 14, which stores each color toner and changes the electrostatic latent image formed on the photoconductor 11 into a visible image by using toner, is provided as an example of a developing unit that forms a toner image by developing the latent image, which is formed on the surface of the image supporting body by the latent image forming unit, with toner and a primary transfer roll 16, which transfers each color toner image formed on the photoconductor 11 to the intermediate transfer belt 15 at the primary transfer section 10, is provided.

Furthermore, a photoconductor cleaner 17, which removes toner remaining on the photoconductor 11, is provided around the photoconductor 11. Accordingly, electrophotographic devices, such as the charger 12, the laser exposure unit 13, the developing section 14, the primary transfer roll 16, and the photoconductor cleaner 17, are sequentially provided in the rotational direction of the photoconductor 11. These image forming units 1Y, 1M, 1C, and 1K are disposed substantially linearly in order of yellow (Y), magenta (M), cyan (C), and black (K) from the upstream side of the intermediate transfer belt 15.

The intermediate transfer belt 15, which is an intermediate transfer body, is formed of a film-like pressure belt that uses a resin, such as polyimide or polyamide, as a base layer and contains an appropriate amount of an antistatic agent such as carbon black. Further, the intermediate transfer belt 15 is formed so as to have a volume resistivity of $10^6$ Ωcm to $10^{14}$ Ωcm, and the thickness of the intermediate transfer belt 15 is, for example, about 0.1 mm.

The intermediate transfer belt 15 is circularly driven (rotated) at a predetermined speed in the direction of an arrow B shown in FIG. 6 by various rolls. These various rolls include a driving roll 31 that is driven by a motor (not shown) having excellent constancy of speed and rotates the intermediate transfer belt 15, a support roll 32 that supports the intermediate transfer belt 15 extending substantially linearly in the arrangement direction of the respective photoconductors 11, a tension roll 33 that applies constant tension to the intermediate transfer belt 15 and functions as a correcting roll preventing the meandering of the intermediate transfer belt 15, a back roll 25 that is provided in the secondary transfer section 20, and a cleaning back roll 34 that is provided in a cleaning unit scraping toner remaining on the intermediate transfer belt 15.

The primary transfer section 10 is formed of the primary transfer roll 16 that is disposed so as to face the photoconductor 11 with the intermediate transfer belt 15 interposed therebetween. The primary transfer roll 16 includes a shaft and a sponge layer as an elastic layer that is fixed around the shaft. The shaft is a cylindrical rod that is made of metal, such as iron or SUS. The sponge layer is made of blended rubber of NBR, SBR, and EPDM to which a conductive agent such as carbon black is mixed, and is a sponge-like cylindrical roll of which the volume resistivity is in the range of $10^{7.5}$ Ωcm to $10^{8.5}$ Ωcm.

Further, the primary transfer roll 16 is disposed so as to be urged against the photoconductor 11 with the intermediate transfer belt 15 interposed therebetween, and a voltage (primary transfer bias) having a polarity opposite to the polarity of charged toner (referred to as a negative polarity similarly hereinafter.) is applied to the primary transfer roll 16. Accordingly, the toner images formed on the respective photoconductors 11 are sequentially and electrostatically attracted to the intermediate transfer belt 15, so that superimposed toner images are formed on the intermediate transfer belt 15.

The secondary transfer section 20 includes the back roll 25 and a secondary transfer roll 22 as an example of a transfer unit that transfers a toner image formed by the developing unit to a recording medium and is disposed on the side of the toner image supporting surface of the intermediate transfer belt 15.

The surface of the back roll 25 is formed of a tube that is made of blended rubber of NBR and EPDM where carbon is dispersed. The inner portion of the back roll 25 is made of EPDM rubber. Further, the back roll 25 is formed so as to have a surface resistivity of $10^7$Ω/□ to $10^{10}$Ω/□, and the hardness of the back roll 25 is set to, for example, 70° (ASKER C manufactured by Kobunshi Keiki Co., Ltd., similarly hereinafter.). The back roll 25 is disposed on the back side of the intermediate transfer belt 15 and forms a counter electrode of the secondary transfer roll 22. A power supply roll 26 to which a secondary transfer bias is stably applied and which is made of metal is disposed so as to come into contact with the back roll 25.

Meanwhile, the secondary transfer roll 22 includes a shaft and a sponge layer as an elastic layer that is fixed around the shaft. The shaft is a cylindrical rod that is made of metal, such as iron or SUS. The sponge layer is made of blended rubber of NBR, SBR, and EPDM to which a conductive agent such as carbon black is mixed, and is a sponge-like cylindrical roll of which the volume resistivity is in the range of $10^{7.5}$ Ωcm to $10^{8.5}$ Ωcm.

Further, the secondary transfer roll 22 is disposed so as to be urged against the back roll 25 with the intermediate transfer belt 15 interposed therebetween and the secondary transfer roll 22 is grounded, so that a secondary transfer bias is generated between the back roll 25 and the secondary transfer roll 22. Accordingly, the secondary transfer roll 22 secondarily transfers the toner images to the sheet K that is transported to the secondary transfer section 20.

Furthermore, an intermediate transfer belt cleaner 35, which removes paper powder or toner remaining on the intermediate transfer belt 15 after secondary transfer to clean the surface of the intermediate transfer belt 15, is provided on the downstream side of the secondary transfer section 20 so as to be freely attached to and detached from the intermediate transfer belt 15.

Meanwhile, a reference sensor (home position sensor) 42, which generates a reference signal serving as the reference used to set an image forming timing of each of the image forming units 1Y, 1M, 1C, and 1K, is provided on the upstream side of the yellow image forming unit 1Y. Further, an mage density sensor 43, which adjusts image quality, is provided on the downstream side of the black image forming unit 1K. The reference sensor 42 recognizes a predetermined mark provided on the back of the intermediate transfer belt 15 and generates a reference signal. Each of the image forming units 1Y, 1M, 1C, and 1K starts forming an image according to an instruction that is generated from the controller 40 and based on the recognition of the reference signal.

Moreover, as a transport unit that transports a sheet K, the image forming apparatus according to this exemplary embodiment includes a sheet accommodating unit 50 that accommodates sheets K; a sheet feeding roll 51 that takes and transports the sheet K stacked in the sheet accommodating unit 50 at a predetermined timing; transport rolls 52 that transport the sheet K taken by the sheet feeding roll 51; a transportation guide 53 that sends the sheet K, which is transported by the transport roll 52, to the secondary transfer section 20; a transport belt 55 that transports the sheet K, which is transported after being subjected to secondary transfer by the secondary transfer roll 22, to the fixing device 60; and a fixing inlet guide 56 that guides the sheet K to the fixing device 60.

Next, a basic image forming process of the image forming apparatus according to this exemplary embodiment will be described.

In the image forming apparatus according to this exemplary embodiment, an image forming operation is performed by the image forming units 1Y, 1M, 1C, and 1K after predetermined image processing is performed on image data, which are output from an image reader (not shown), a personal computer (PC), or the like, by an image processing device (not shown).

Predetermined image processing, that is, various kinds of image editing, such as shading correction, positional deviation correction, brightness/color space conversion, gamma correction, edge or color editing, and movement editing, are performed on input reflectance data in the image processing device. The image data, which has been subjected to image processing, are converted into gradation data of four color (Y, M, C, and K) materials, and are output to the laser exposure unit 13.

In the laser exposure units 13, the respective photoconductors 11 of the image forming units 1Y, 1M, 1C, and 1K are irradiated with exposure beams Bm emitted from, for example, semiconductor lasers according to the input gradation data of color materials. The surfaces of the respective photoconductors 11 of the image forming units 1Y, 1M, 1C, and 1K are scanned and exposed by the laser exposure units 13 after being charged by the chargers 12. Accordingly, electrostatic latent images are formed on the photoconductors. The formed electrostatic latent images are developed as the respective color (Y, M, C, and K) toner images by the respective image forming units 1Y, 1M, 10, and 1K.

The toner images, which are formed on the photoconductors 11 of the image forming units 1Y, 1M, 10, and 1K, are transferred to the intermediate transfer belt 15 at the primary transfer sections 10 where the respective photoconductors 11 come into contact with the intermediate transfer belt 15. More specifically, at the primary transfer sections 10, a voltage (primary transfer bias) having a polarity opposite to the polarity of charged toner (negative polarity) is applied to a base material of the intermediate transfer belt 15 by the primary transfer rolls 16 and the toner images are sequentially superimposed on the surface of the intermediate transfer belt 15, so that primary transfer is performed.

After the toner images are sequentially and primarily transferred to the surface of the intermediate transfer belt 15, the intermediate transfer belt 15 is moved so that the toner images are transported to the secondary transfer section 20. When the toner images are transported to the secondary transfer section 20, the sheet feeding roll 51 is rotated in the transport unit at the timing where the toner images are transported to the secondary transfer section 20. Accordingly, a sheet K having a predetermined size is fed from the sheet accommodating unit 50. The sheet K, which is fed by the sheet feeding roll 51, is transported by the transport rolls 52, and reaches the secondary transfer section 20 via the transportation guide 53. Before reaching the secondary transfer section 20, the sheet K is stopped and a registration roll (not shown) is rotated at the timing when the intermediate transfer belt 15 on which the toner images are supported is moved. Accordingly, the position of the sheet K corresponds to the positions of the toner images.

At the secondary transfer section 20, the secondary transfer roll 22 is pressed against the back roll 25 with the intermediate transfer belt 15 interposed therebetween. In this case, the sheet K, which is transported at the timing, is interposed between the intermediate transfer belt 15 and the secondary transfer roll 22. At that time, when a voltage (secondary transfer bias) having the same polarity as the polarity of charged toner (negative polarity) is applied to the back roll from power supply roll 26, a transfer electric field is formed between the secondary transfer roll 22 and the back roll 25. Further, the unfixed toner images, which are supported on the intermediate transfer belt 15, are collectively and electrostatically transferred to the sheet K at the secondary transfer section 20 that applies pressure by the secondary transfer roll 22 and the back roll 25.

After that, while being released from the transfer belt 15 by the secondary transfer roll 22, the sheet K to which the toner images have been electrostatically transferred is transported as it is and is transported to the transport belt 55 provided on the downstream side of the secondary transfer roll 22 in a sheet transport direction. The transport belt 55 transports the sheet K to the fixing device 60 at an optimal transport speed of the fixing device 60. Fixing processing is performed on the unfixed toner images, which are electrostatically transferred to the sheet K transported to the fixing device 60, with heat and pressure by the fixing device 60, so that the unfixed toner images are fixed to the sheet K. The sheet K on which the fixed images have been formed is transported to an ejected sheet accommodating unit (not shown) that is provided at a discharge unit of the image forming apparatus.

Meanwhile, residual toner, which remains on the intermediate transfer belt 15 after the transfer of the images to the sheet K is completed, is transported to the cleaning unit with the rotation of the intermediate transfer belt 15, and is removed from the intermediate transfer belt 15 by the cleaning back roll 34 and the intermediate transfer belt cleaner 35.

The exemplary embodiments of the invention have been described above. However, the invention is not limited to the above-mentioned exemplary embodiments, and may have various changes, alterations, and modifications. It goes without saying that the invention may be embodied within the range satisfying the requirements of the invention.

Meanwhile, an electrophotographic image forming apparatus has been described as the image forming apparatus according to this exemplary embodiment. However, the image forming apparatus according to this exemplary embodiment is not limited to the electrophotographic image forming apparatus, and may be a known image forming apparatus (for example, an ink jet recording apparatus, which includes an endless belt for transporting a sheet, or the like) other than the electrophotographic image forming apparatus.

EXAMPLES

The invention will be more specifically described with reference to examples. However, the invention is not limited to these examples at all.

Example 1

First, through holes are formed at a cross-linked PTFE sheet (EXCELLON XF-1B manufactured by Hitachi Cable, Ltd., thickness: 0.1 mm) by a $CO_2$ laser. Specifically, a sheet having dimensions of 150 mm×380 mm×0.1 mm is used as the cross-linked PTFE sheet, and through holes having a diameter of 0.2 mm are formed at a portion of the central portion, which corresponds to the dimensions of 60 mm×380 mm, of the sheet at a pitch of 0.6 mm.

Next, a polyimide sheet having the dimensions of 150 mm×380 mm×0.09 mm and a fluorine-based adhesive sheet (SILKY BOND manufactured by Junkosha Co., Ltd.) having the dimensions of 150 mm×380 mm×0.015 mm are prepared.

Further, the fluorine-based adhesive sheet is interposed between the polyimide sheet and the cross-linked PTFE sheet with the through holes. Pressure of 1 MPa is applied to these sheets from the upper and lower sides of these sheets and these sheets are heated at a temperature of 330° C. for 10 minutes so that these sheets are bonded to each other.

Accordingly, a sheet-like sliding member having the same structure as the sliding member 101*a* is obtained.

Example 2

A cross-linked PTFE sheet with through holes is obtained entirely in the same manner as Example 1 except that a punching method is used to form the cross-linked PTFE sheet with through holes instead of a machining method using a $CO_2$ laser.

A laminated body of a polyimide sheet, a fluorine-based adhesive sheet, and a cross-linked PTFE sheet with through holes is bonded under the same conditions as Example 1 by using the cross-linked PTFE sheet with through holes.

Accordingly, a sheet-like sliding member having the same structure as the sliding member 101*a* is obtained.

Example 3

First, through holes are formed at a cross-linked PTFE sheet (EXCELLON XF-1B manufactured by Hitachi Cable, Ltd., thickness: 0.1 mm) by a $CO_2$ laser. Specifically, a sheet having dimensions of 150 mm×380 mm×0.1 mm is used as the cross-linked PTFE sheet, and through holes having a diameter of 0.2 mm are formed at a portion of the central portion, which corresponds to the dimensions of 60 mm×380 mm, of the sheet at a pitch of 0.6 mm.

Next, a fluorine-based adhesive sheet with through holes is prepared using the same method as described above. That is, there is prepared a sheet, which is obtained by forming through holes (of which the diameter is 0.2 mm and the pitch is 0.6 mm) at a portion, which corresponds to the dimensions of 60 mm×380 mm, of the central portion of a fluorine-based adhesive sheet (SILKY BOND manufactured by Junkosha Co., Ltd.), which has the dimensions of 150 mm×380 mm×0.015 mm, by a $CO_2$ laser.

Further, a polyimide sheet having the dimensions of 150 mm×380 mm×0.09 mm, a fluorine-based adhesive sheet (SILKY BOND manufactured by Junkosha Co., Ltd., without through holes) having the dimensions of 150 mm×380 mm×0.015 mm, and a fluorine resin fiber sheet (GORE FIBER CLOTH FS120-E manufactured by Japan Gore-Tex, Inc.) having the dimensions of 150 mm×380 mm×0.12 mm are prepared.

Furthermore, a laminated body is formed by laminating the polyimide sheet, the fluorine-based adhesive sheet (without through holes), the fluorine resin fiber sheet, the fluorine-based adhesive sheet with through holes, and the cross-linked PTFE sheet with through holes in this order. Pressure of 1 MPa is applied to the laminated body from the upper and lower sides of the laminated body and the laminated body is heated at a temperature of 330° C. for 10 minutes so that these sheets are bonded to each other.

Accordingly, a sheet-like sliding member having the same structure as the sliding member 101*b* is obtained.

Example 4

A cross-linked PTFE sheet with through holes is obtained entirely in the same manner as Example 3 except that a punching method is used to form the cross-linked PTFE sheet with through holes instead of a machining method using a $CO_2$ laser.

A laminated body where a polyimide sheet, a fluorine-based adhesive sheet (without through holes), a fluorine resin fiber sheet, a fluorine-based adhesive sheet with through holes, and a cross-linked PTFE sheet with through holes are laminated in this order is bonded.

Accordingly, a sheet-like sliding member having the same structure as the sliding member 101*b* is obtained.

Comparative Example 1

Embossing, which forms lattice-like concave and convex portions on the surface of the cross-linked PTFE sheet, is performed with a metal mesh (30 mesh, diameter: 0.2 mm) by applying pressure to a cross-linked PTFE sheet (EXCELLON XF-1B_0.2T manufactured by Hitachi Cable, Ltd.) having a thickness of 0.2 mm while heating the cross-linked PTFE sheet at a temperature of 180° C. Here, the depth of a formed concave portion is 0.05 mm.

A sheet-like sliding member is obtained by making the cross-linked PTFE sheet adhere to a polyimide sheet having a thickness of 0.09 mm with a heat-resistant silicon adhesive.

<Evaluation>

The durability of the sliding member is evaluated by visually observing the state of the sliding member when the sheet-like sliding member, which is obtained from each example, is mounted on a belt-roll nip type fixing device (see FIG. 5: the surface roughness Ra of the inner surface of the heating belt where the sheet-like sliding member is disposed=0.6 μm) of a high-speed copy machine (Color1000 Press manufactured by Fuji Xerox Co., Ltd.) and the high-speed copy machine is continuously operated while a process speed is increased to 180 ppm (pages per minute) and 800 mm/sec. Results are shown in Table 1.

—Durability Evaluation Indexes—

The evaluation reference of durability of the sliding member is as follows:

⊕: The deterioration of the sliding member (the increase of sliding resistance or black dirt caused by abrasion powder) does not appear even after 1,200,000 pages (1.2 Mpv).

O: The deterioration of the sliding member (the increase of sliding resistance or black dirt caused by abrasion powder) does not appear even after 800,000 pages (800 Kpv).

X: The deterioration of the sliding member (the increase of sliding resistance or black dirt caused by abrasion powder) appears even until 600,000 pages (600 Kpv).

TABLE 1

| | Durability |
|---|---|
| Example 1 | ○ |
| Example 2 | ○ |
| Example 3 | ⊕ |
| Example 4 | ⊕ |
| Comparative Example 1 | X |

From the above-mentioned results, it is found that the sheet-like sliding member of this example has excellent durability as compared to Comparative Example 1.

The reason for this is that the sheet-like sliding member of this example has excellent oil holding performance, so that the increase of the coefficient of friction between the sliding member of this example and a member subjected to sliding (heating belt) is suppressed and the suppression is maintained.

Since the durability of the sliding member of this example is excellent as described above, the life of the sliding member of this example is lengthened. As a result, it is possible to lengthen the life of a fixing device or an image forming apparatus including the sliding member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sliding member for a fixing device, the sliding member comprising:

a base body; and a sliding sheet that is disposed on the surface of the base body and is made of cross-linked polytetrafluoroethylene provided with through holes passing therethrough in a thickness direction.

2. The sliding member for a fixing device according to claim 1, further comprising:

a fluorine resin fiber layer that is provided between the base body and the sliding sheet.

3. The sliding member for a fixing device according to claim 2, further comprising:

a fluorine-based adhesive sheet that is provided between the base body and the sliding sheet.

4. The sliding member for a fixing device according to claim 3, wherein an interval between the through holes is in the range of 0.2 mm to 2.0 mm, and the area of each of the through holes is in the range of $7\times10^{-3}$ $mm^2$ to 3.2 $mm^2$.

5. The sliding member for a fixing device according to claim 2, wherein an interval between the through holes is in the range of 0.2 mm to 2.0 mm, and the area of each of the through holes is in the range of $7\times10^{-3}$ $mm^2$ to 3.2 $mm^2$.

6. The sliding member for a fixing device according to claim 1, further comprising:

a fluorine-based adhesive sheet that is provided between the base body and the sliding sheet.

7. The sliding member for a fixing device according to claim 6, wherein an interval between the through holes is in the range of 0.2 mm to 2.0 mm, and the area of each of the through holes is in the range of $7\times10^{-3}$ $mm^2$ to 3.2 $mm^2$.

8. The sliding member for a fixing device according to claim 1, wherein an interval between the through holes is in the range of 0.2 mm to 2.0 mm, and the area of each of the through holes is in the range of $7\times10^{-3}$ $mm^2$ to 3.2 $mm^2$.

9. A fixing device comprising:

a first rotating body;

a second rotating body that is disposed so as to come into contact with the outer surface of the first rotating body;

a pressing member that is disposed on the inside of the second rotating body and presses the second rotating body against the first rotating body from the inner surface of the second rotating body;

the sliding member for a fixing device according to claim 1, the sliding member being interposed between the inner surface of the second rotating body and the pressing member; and a heating source that heats at least one of the first and second rotating bodies.

10. The fixing device according to claim 9, wherein the surface roughness Ra of the inner surface of the second rotating body is in the range of 0.1 μm to 2.0 μm.

11. An image forming apparatus comprising:

an image supporting body;

a charging unit that charges the surface of the image supporting body;

a latent image forming unit that forms a latent image on the surface of the charged image supporting body;

a developing unit that forms a toner image by developing the latent image with toner;

a transfer unit that transfers the toner image to a recording medium; and a fixing unit that fixes the toner image to the recording medium and is the fixing device according to claim 9.

* * * * *